US006558114B1

(12) United States Patent
Tapley et al.

(10) Patent No.: US 6,558,114 B1
(45) Date of Patent: May 6, 2003

(54) GAS TURBINE WITH BAFFLE REDUCING HOT GAS INGRESS INTO INTERSTAGE DISC CAVITY

(75) Inventors: Joseph Theodore Tapley, Casselberry, FL (US); John Y. Xia, Winter Springs, FL (US); Zhenhua Xiao, Winter Springs, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/676,061

(22) Filed: Sep. 29, 2000

(51) Int. Cl.[7] ..... F01D 11/04

(52) U.S. Cl. ..... 415/111; 415/115; 415/116; 415/173.7; 415/174.5; 415/180; 415/231

(58) Field of Search ..... 415/110–112, 115, 415/116, 173.7, 174.4, 174.5, 176, 180, 231

(56) References Cited

U.S. PATENT DOCUMENTS

| | | | | |
|---|---|---|---|---|
| 2,919,891 A | * | 1/1960 | Oliver | 415/180 |
| 3,647,311 A | * | 3/1972 | Wootton et al. | 415/173.7 |
| 3,727,660 A | * | 4/1973 | Burge | 415/173.7 |
| 3,829,233 A | * | 8/1974 | Scalzo et al. | 415/110 |
| 3,945,758 A | * | 3/1976 | Lee | 415/115 |
| 4,113,406 A | * | 9/1978 | Lee et al. | 415/115 |
| 4,190,397 A | | 2/1980 | Schilling et al. | |
| 4,904,156 A | | 2/1990 | Touze | |
| 5,090,865 A | | 2/1992 | Ramachandran et al. | |
| 5,215,435 A | * | 6/1993 | Webb et al. | 415/173.7 |
| 5,259,725 A | | 11/1993 | Hemmelgarn et al. | |
| 5,332,358 A | | 7/1994 | Hemmelgarn et al. | |
| 5,488,825 A | * | 2/1996 | Davis et al. | 415/115 |
| 6,152,685 A | * | 11/2000 | Hagi | 415/116 |
| 6,152,690 A | * | 11/2000 | Tomita et al. | 415/173.7 |
| 6,217,279 B1 | * | 4/2001 | Ai et al. | 415/110 |

FOREIGN PATENT DOCUMENTS

| | | | | |
|---|---|---|---|---|
| JP | 52-25917 A | * | 2/1977 | 415/115 |

* cited by examiner

*Primary Examiner*—Christopher Verdier

(57) ABSTRACT

The subcavity between a stator seal assembly and the upstream rotor disc in the interstage disc cavity of a gas turbine is divided into a radially inward region and a radially outward region by an annular baffle that extends from the seal assembly partially across the subcavity toward the rotor disc. The volume of cooling air injected into the interstage disc cavity can be reduced to increase turbine efficiency because the baffle interrupts recirculation in the subcavity to confine ingress of the hot main gas flow to the radially outward region away from the rotor seals.

6 Claims, 3 Drawing Sheets

GAS TURBINE WITH BAFFLE REDUCING HOT GAS INGRESS INTO INTERSTAGE DISC CAVITY

BACKGROUND OF THE INVENTION

1. Field of the Invention

This invention relates to gas turbines in which cooling air is introduced into the interstage disc cavities containing the stator to rotor shaft seals. More particularly, it relates to an arrangement which confines the ingress of hot main gas flow into the interstage disc cavities to regions capable of withstanding high temperatures, thereby reducing the cooling air requirements to provide increased turbine efficiency.

2. Background Information

Gas turbines such as those used to drive electric power generators have a number of rotor discs axially spaced along a rotor shaft to form interstage disc cavities. Stages of the stator extend radially inward from the turbine casing into the interstage disc cavities. Each stator stage includes a number of stator vanes secured to the turbine casing and a seal assembly which seals against the rotor shaft to prevent main gas flow from bypassing the vanes.

The stator sections of the turbine form with the upstream rotor discs annular subcavities within the interstage disc cavities. Cooling air bled from the turbine compressor is introduced from the stator shaft into the interstage disc cavities to cool and seal the seal assemblies. The cooling air flows radially through the interstage disc cavities, including the subcavities, and passes outward through a rim seal into the main gas flow.

Despite the provision of the rim seal and an adjoining rim seal cavity at the exit of the subcavity, some main gas flow ingresses into the subcavities. Pressure variations induced by the rotating parts cause recirculation within the subcavities, thus drawing the very hot main gas flow toward the stator to rotor seals. Sufficient cooling gas must be provided to protect these seals from the hot main gas ingress. This reduces the overall efficiency of the gas turbine.

There is a need, therefore, for an improved gas turbine with increased efficiency.

More particularly, there is a need for a reduction in the volume of cooling air needed to cool components in the interstage disc cavities of a gas turbine.

There is a more specific need for an arrangement which reduces heating within the interstage disc cavities of a gas turbine due to ingress of main gas flow into the interstage disc cavities.

SUMMARY OF THE INVENTION

These needs, and others, are satisfied by the invention which is directed to an improved gas turbine which reduces the volume of cooling air needed for cooling the interstage disc cavities by confining the ingress of hot main gas flow to regions of the interstage disc cavities which can withstand high temperatures. More particularly, the invention is directed to a gas turbine comprising a turbine casing and a rotor mounted for rotation within the casing and comprising a rotor shaft with at least first stage and second stage rotor discs axially displaced on the rotor shaft to form an interstage disc cavity. A stator has at least one stator stage extending radially inward into the interstage disc cavity from the turbine casing toward the rotor shaft. The stator stage has a plurality of stator vanes axially aligned with rotor blades carried by the rotor discs and terminates radially inward with a seal assembly which seals against the rotor shaft. The stator stage forms with the first stage rotor disc an annular subcavity within the interstage disc cavity. A cooling system within the rotor shaft introduces into the interstage disc cavity cooling air which passes radially outward through the interstage disc cavity including the subcavity and is discharged into the main gas flow. The gas turbine of the invention also includes a baffle extending from the seal assembly partially across the subcavity toward the first stage rotor disc. The baffle divides the subcavity into a radially inward region and a radially outward region. The baffle is configured and positioned to confine ingress from the main gas flow into the radially outward region. Thus, the radially inward region is protected from the hot main gases. This permits the volume of the cooling gas to be reduced, resulting in an increase in efficiency of the turbine.

The baffle is an annular flange secured to the seal assembly. Where the stator stage includes bolts connecting the seal assembly to the stator vanes, and these bolts have heads projecting axially into the subcavity, the baffle is positioned radially outward of the bolt heads, so that they are in the radially inward region of the subcavity and protected from the ingress from the main gas flow. Again, the baffle is preferably an annular flange and extends axially from the seal assembly beyond the bolt heads. The baffle extends axially at least ⅓ and not more than ⅔ across the subcavity and preferably from between about ½ and ⅔. In the most preferred arrangement, the baffle extends about ⅔ across the subcavity.

Similar baffles can be provided in the additional downstream subcavities within an additional interstage disc cavities in the gas turbine.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
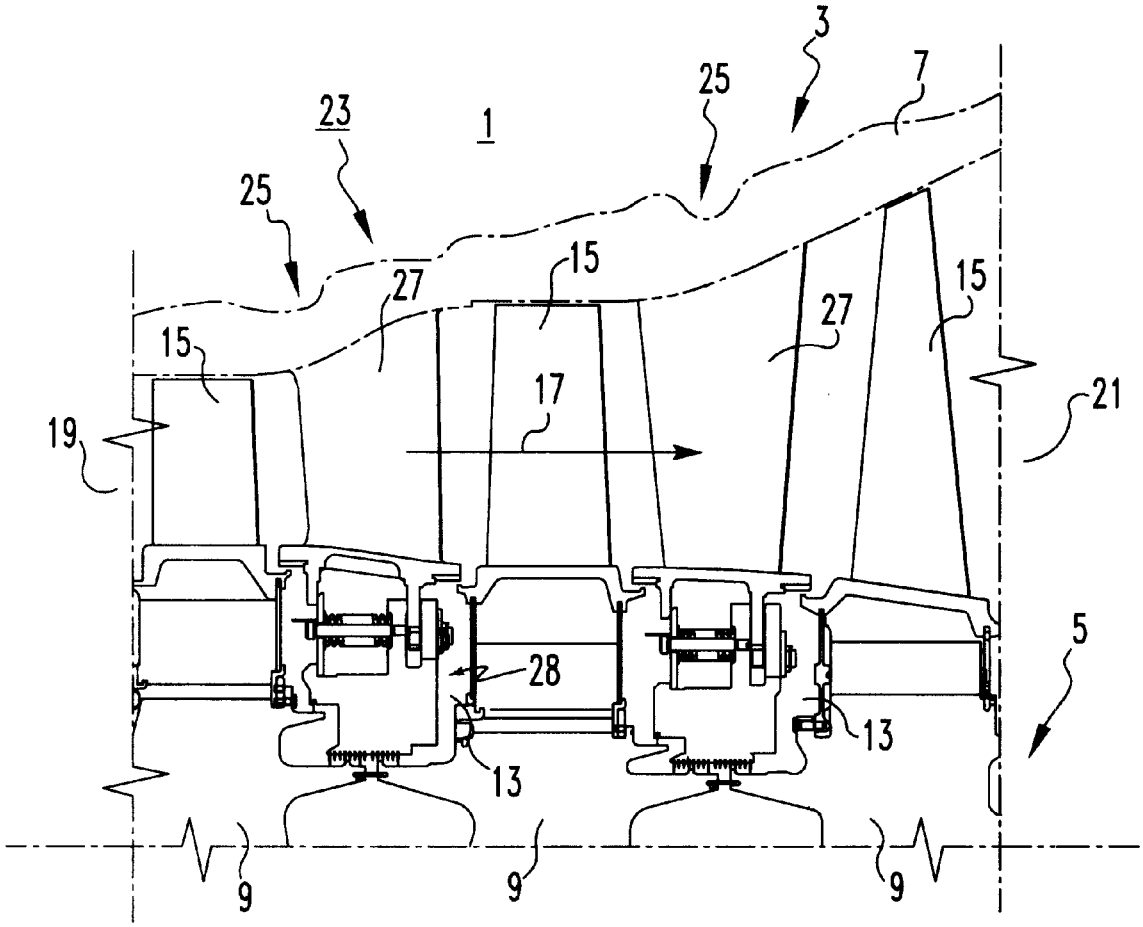
FIG. 1 is a partial longitudinal sectional view through a gas turbine incorporating the invention.

Referring to FIG. 1, the gas turbine 1 has a turbine section 3 in which a rotor 5 is mounted for rotation within a turbine casing 7. The rotor 5 has a number of rotor discs 9 axially spaced along a rotor shaft 11 to form interstage disc cavities 13. While the details of the rotor discs 9 are not shown in FIG. 1 and are not relevant to the present invention, each of the discs includes a number of rotor blades 15 which extend radially outward toward the turbine casing 7 into the main gas flow path 17 extending from the turbine inlet 19 toward the turbine outlet 21.

The gas turbine 1 also includes a stator 23 having a number of stator stages or sections 25, each extending radially inward from the turbine casing 7 into the interstage disc cavities 13. Each of the stator sections includes a plurality of stator vanes 27 secured to the turbine casing 3 in axial alignment in the main gas flow 17 with the rotor blades 15. As best viewed in FIG. 2, the stator sections 25 include a seal assembly 28 comprising an interstage seal housing 29 and associated seals. The interstage seal housing 29 has a clevis 31 through which it is secured to flanges 33 on the stator vanes by bolts 35 with clearance so that the seal assembly floats between the stator vanes 35 and the rotor shaft 11. A labyrinth seal 37 carried by the interstage seal housing 29 seals against the rotor shaft 11. Another labyrinth seal 41 extends between the interstage seal housing 29 and flange 43 on the upstream rotor disc. An annular seal plate 45 is seated against a lip 47 on the interstage seal housing 29 and a flange 49 on the stator vanes 27 by a helical compression spring 51 which bears against and is positioned relative to an upstream face of the clevis 31 by a bolt 53. As can be seen, the stator sections 25 divide the interstage disc cavities 13 into upstream and downstream subcavities **55*u* and 55*d*. The seals 37 and 41 aided by rim seals 57 and 59 formed at the upper ends of the subcavities by rims on the upstream and downstream rotor discs restrict main gas flow 17** from bypassing the stator vanes.

Cooling air bled from the turbine compressor (not shown) is introduced through the stator vanes (not shown) into the interstage disc cavities 55 through cooling air inlet 61 in the seal housing 29 to cool the seals. The cooling air flows radially outward through the interstage disc cavities 13, including the subcavities **55*u* and 55*d*, and passes outward through the rim seals 57 and 59** into the main gas flow.

Figure 4:
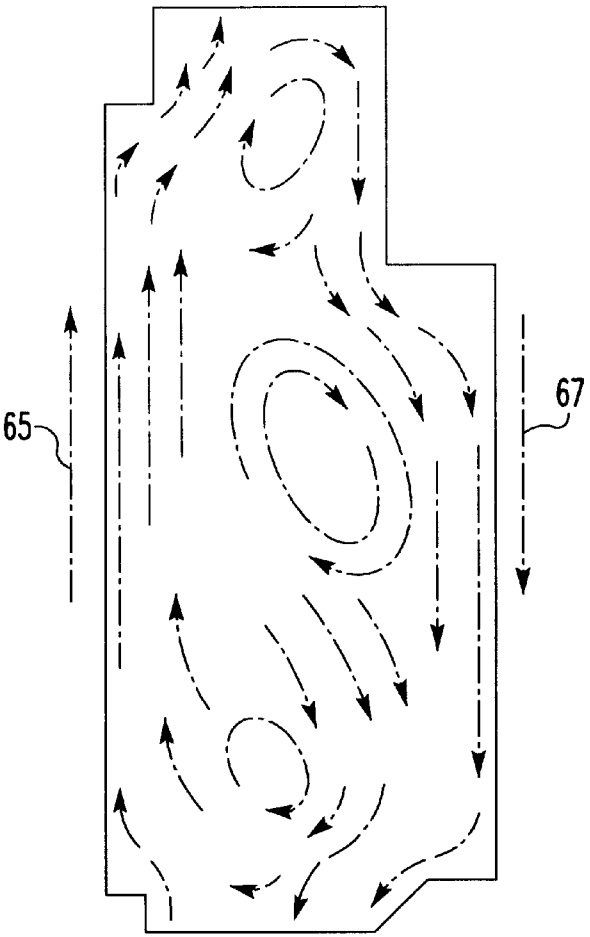
FIG. 4 is a schematic illustration of flow within the upstream interstage disc subcavity of the turbine without the invention.

Despite the provision of the rim seal 57 and an adjoining rim seal cavity at 63, some main gas flow 17 ingresses into the subcavity **55*u*. Pressure variations induced by the rotating parts cause recirculation within the subcavities thus drawing the very hot main gas flow toward the stator to rotor seals 37 and 41. As shown schematically in FIG. 4, the flow of cooling air passes upward in the forward portion of the subcavity 55*u* as indicated by the arrow 65 and the recirculation occurs predominately along the aft portion of the subcavity as indicated by the arrow 67. In order to protect the seals 37 and 41** from the hot main gas ingress, sufficient cooling gas must be provided which reduces the overall efficiency of the gas turbine.

Figure 2:
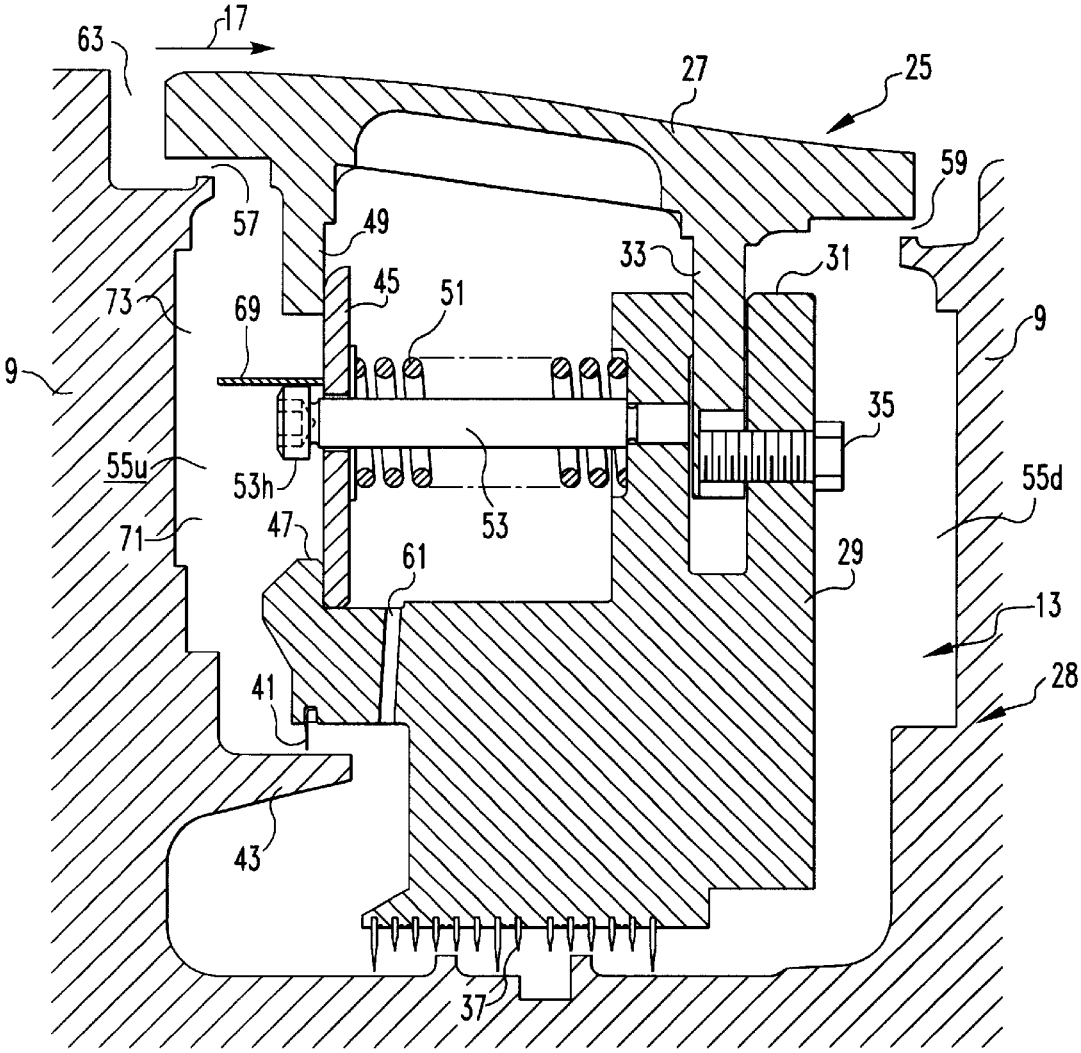
FIG. 2 is a section of FIG. 1 showing the interstage disc cavity in enlarged scale.
Figure 3:
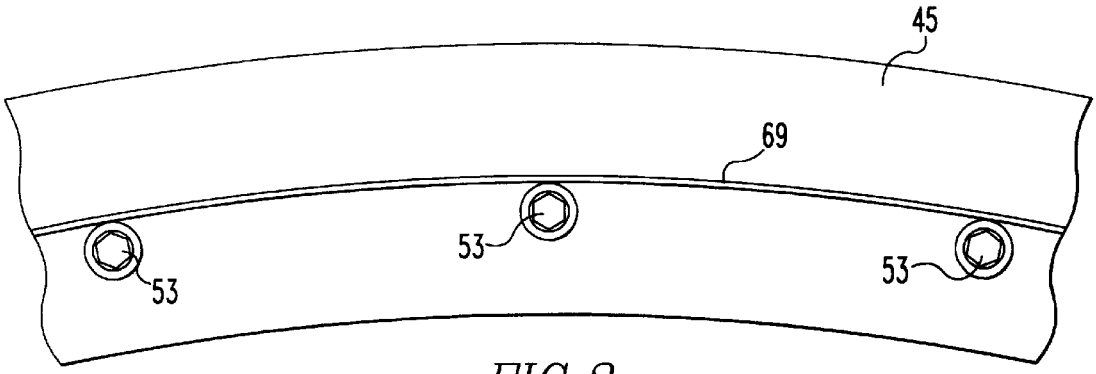
FIG. 3 is a fragmentary sectional view of a portion of the interstage disc cavity illustrating the baffle which is part of the invention.

In accordance with the invention, a baffle 69 in the form of an annular flange is secured to the seal assembly 28 and extends partially across the subcavity **55*u* thereby dividing it into a radially inward region 71 and a radially outward region 73. The baffle 69 is positioned and configured to confine the ingress of main gas flow to the radially outward region 73 of the subcavity 55*u*. As shown in FIG. 2, the baffle 69 is positioned so that the heads 53*h* of the bolts 53 are in the radially inward region 71 of the subcavity 55*u* and therefore protected from the high temperatures along with the seals 37 and 41. In the exemplary embodiment of the invention, the baffle 69 is secured such as by welding to the annular seal plate 45**.

Figure 5:
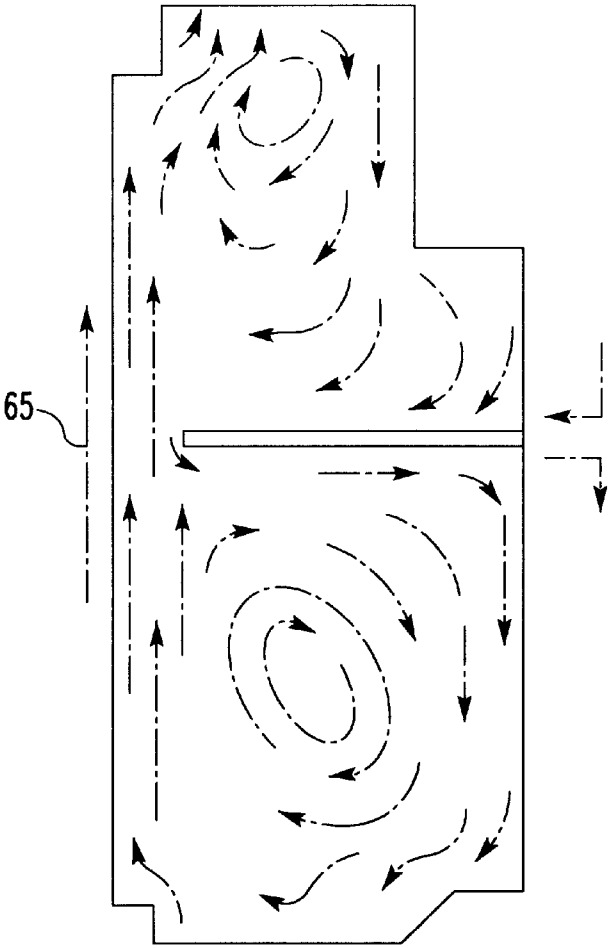
FIG. 5 is similar to FIG. 4 illustrating the modification to the flow pattern resulting from application of the invention.

With this baffle 69, the flow within the subcavity **55*u* is modified as shown in FIG. 5 so that most of the ingress from the main flow is recirculated in the radially outward region 73 of the subcavity 55*u***.

The baffle 69 is a circumferentially continuous flange which extends axially from the seal plate 45 beyond the heads of the bolts 53. As discussed, the baffle extends partially across the subcavity **55*u* to an extent which minimizes the ingress of main gas flow into the radially inward region 71 of the subcavity where the seals 37 and 41 and heads of the bolts 53 are located. Ideally, the baffle extends as far across the subcavity 55*u* as possible while leaving an opening for cooling air to flow radially outward, but in industrial turbines which are assembled radially, the axial length of the baffle is limited by the axial position of the rim seal 57 which must be cleared as the stator section is inserted into the interstage cavity 13. Thus, in this latter case, the baffle extends at least about ⅓ and no more than about ⅔ across the subcavity 55*u* and preferably extends from about ½ to about ⅔. In the exemplary embodiment, the baffle 69** extends about ⅔ across the subcavity.

With the baffle 69 the ingress of main gas flow is localized in the portions of the subcavity that can withstand high temperature conditions. Thus, the mass flow of secondary cooling air supplied to the subcavity can be reduced. The cooling air which now does not have to be directed to the subcavity can be rebudgeted to other areas that are in higher need of cooling. Overall, the invention can lower the amount of necessary cooling air and thereby increase turbine performance.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A gas turbine comprising:

a turbine casing;

a rotor mounted for rotation within the turbine casing and comprising a rotor shaft and at least first stage and second stage rotor discs axially displaced on the rotor shaft to form an interstage disc cavity, the first stage and second stage rotor discs each having a plurality of rotor blades extending radially outward into a main gas flow;

a stator comprising at least one stator stage extending radially inward into the interstage disc cavity from the turbine casing toward the rotor shaft, the at least one stator stage having a plurality of stator vanes axially aligned with the rotor blades in the main gas flow and terminating radially inwardly with a seal assembly which seals against the rotor shaft, the at least one stator stage forming with the first stage rotor disc an annular subcavity within the interstage disc cavity, said at least one stator stage including bolts connecting the seal assembly to the stator vanes and having bolt heads projecting axially into the subcavity;

a cooling air inlet introducing into the interstage disc cavity cooling air which passes radially outward through the interstage disc cavity including the subcavity and is discharged into the main gas flow; and a baffle extending from the seal assembly partially across the subcavity toward the first stage rotor disc dividing the subcavity into a radially inward region and a radially outward region, the baffle being configured and positioned to confine ingress from the main gas flow to the radially outward region, the baffle being positioned radially outward of the bolt heads so that the bolt heads are in the radially inward region of the subcavity and protected from the ingress from the main gas flow, said baffle extending axially at least about ⅓ but no more than about ⅔ across the subcavity.

2. The gas turbine of claim 1 wherein the baffle is an annular flange secured to the seal assembly.

3. The gas turbine of claim 1 wherein the rotor includes additional rotor discs spaced axially along the rotor shaft to form additional interstage disc cavities, the stator includes additional stator stages each extending radially inward into an additional interstage disc cavity and having a seal assembly sealing against the rotor shaft and forming with an upstream rotor disc an additional subcavity, the cooling air inlet introduces into the additional interstage disc cavities cooling air which flows radially outward through the additional interstage disc cavities including the additional subcavities, and additional baffles extend from the additional seal assemblies partially across the additional subcavities dividing the subcavities into radially inward regions and radially outward regions, the additional baffles being configured and positioned to confine ingress from the main gas flow to the radially outward regions.

4. The gas turbine of claim 3 wherein the baffle and the additional baffles comprise annular flanges extending axially from the seal assemblies.

5. Apparatus for reducing ingress of main gas flow into a subcavity between a seal assembly of a stator stage including a plurality of stator vanes and an upstream rotor disc in a gas turbine interstage disc cavity into which cooling air is injected, the apparatus comprising:

a baffle extending from the seal assembly partially across the subcavity toward the upstream rotor disc dividing the subcavity into a radially inward region and a radially outward region, the baffle being configured and positioned to confine ingress from the main gas flow into the radially outward region;

and bolts connecting the seal assembly to the stator vanes, said bolts having bolt heads projecting axially into the subcavity, the baffle being positioned radially outward of the bolt heads so that the bolt heads are in the radially inward region of the subcavity and protected from the ingress of the main gas flow, said baffle extending axially at least about ⅓ but no more than about ⅔ across the subcavity.

6. The apparatus of claim 5 wherein the baffle comprises an annular flange secured to the seal assembly.

* * * * *